United States Patent [19]

Sullivan

[11] Patent Number: 4,867,093

[45] Date of Patent: Sep. 19, 1989

[54] PONTOON

[75] Inventor: John F. Sullivan, Greenwood Lake, N.Y.

[73] Assignee: Sullivan Flotation Systems, Inc., Warwick, N.Y.

[21] Appl. No.: 122,823

[22] Filed: Nov. 19, 1987

[51] Int. Cl.[4] ..... B63B 35/38

[52] U.S. Cl. ..... 114/267; 114/263

[58] Field of Search ..... 114/266, 267, 263, 77 R; 441/1, 127; 264/45.5, 53

[56] References Cited

U.S. PATENT DOCUMENTS

| | | | |
|---|---|---|---|
| 3,289,621 | 12/1966 | Sebring | 114/266 |
| 3,323,151 | 6/1967 | Lerman | 441/127 |
| 3,760,754 | 9/1973 | Drummond et al. | 114/266 |
| 3,970,024 | 7/1976 | Fisher | 114/266 |
| 4,548,775 | 10/1985 | Hayashi et al. | 264/45.5 |
| 4,655,156 | 4/1987 | Svirklys et al. | 114/267 |

FOREIGN PATENT DOCUMENTS

| | | | |
|---|---|---|---|
| 2543908 | 10/1984 | France | 114/267 |

OTHER PUBLICATIONS

"Boat & Motor Dealer", Jul. 1986.
Follansbee(TM)—"MOD-U-FLOAT"(TM).
Follansbee Dock Systems-"Poly-Float".

*Primary Examiner*—Joseph F. Peters, Jr.
*Assistant Examiner*—Jesûs D. Sotelo

[57] ABSTRACT

A pontoon for supporting a dock structure in the water includes a core member of buoyant material encased in a plastic closure member. Bottom and top walls of substantially the same dimensions are substantially parallel with each other and are interconnected by slightly rounded sidewalls. The thickness of the pontoon is substantially reduced with respect to its width. The core is advantageously made of extruded styrofoam and attached to the dock structure by through bolting.

9 Claims, 3 Drawing Sheets

PONTOON

BACKGROUND OF THE INVENTION

The present invention relates to floating dock systems and particularly to pontoons used in such systems. Different floating members (pontoons) for supporting structures in the water have long been known and used particularly for building marinas and various dock systems.

It is important to provide floating members which would, upon installation in water, provide the ability to: (1) withstand the natural abuse of the environment such as moisture, exposure to gasoline and oils present in the water of the marina, and weather conditions; (2) to provide long time durability and easy maintenance; and (3) to be rodent and crab protected.

It is also important that the pontoons provide a stable and secure support for the structure attached thereto. The prior art floating members utilize core flotation material which is usually expanded polystyrene "beadboard". Beadboard has a tendency to flake off in pieces and has a tendency to absorb water. The polystyrene core is typically covered with high density polyethylene casing.

The prior art floating members (modules) exhibit a relatively bulky structure with sidewalls tapered inwardly towards the bottom. The thickness of the tapered modules is smaller than but substantially comparable to the width. The tapered shape of the pontoons does not contribute to stability of the supported structure.

For example, for a floating member having a top wall width of about 4 feet, the width of the bottom wall would be between 3 and 3½ feet. The thickness of the standard pontoon in the prior art was between 17 and 24 inches.

The prior art floating members are either lag bolted or strapped to the dock structure. To facilitate attachment, some floating members (pontoons) are provided with flanges around the edge of the top wall for fastening to dock structure. Sometimes recesses are incorporated along the sides of floating members offering ample wrench clearance for assembly to any metal or wood dock structure. Such methods of attaching pontoons to dock structure do not produce a very secure structure.

SUMMARY OF THE INVENTION

It is the purpose of the present invention to provide a pontoon for use with dock systems which has new and superior qualities with respect to those of the prior art pontoons.

The shape of the present invention floating member is designed to allow more stable support for the floating dock. A minimum or non-existent taper and lesser thickness provides an increased water surface ratio. Furthermore, the materials used for the core allow a reduction in the thickness of the pontoon and also provide more secure means of attaching the pontoon to the structure to be supported.

To this end, the present invention pontoon comprises a floating member including a core of buoyant material encased in a closure member made of a plastic material of higher density than that of the buoyant material. The closure member includes a bottom member and a top member which have substantially the same dimensions and are substantially parallel with each other. The thickness of the floating member is small with respect to its width. In the preferred embodiment, the floating core is made of extruded styrofoam and the floating member is securely fastened with through bolts extending through the closure and the core into the supported structure.

The preferred embodiment of the pontoon according to the present invention will now be discussed in more detail with reference to the accompanying drawings, wherein:

DESCRIPTION OF THE PREFERRED EMBODIMENT

Figure 1:
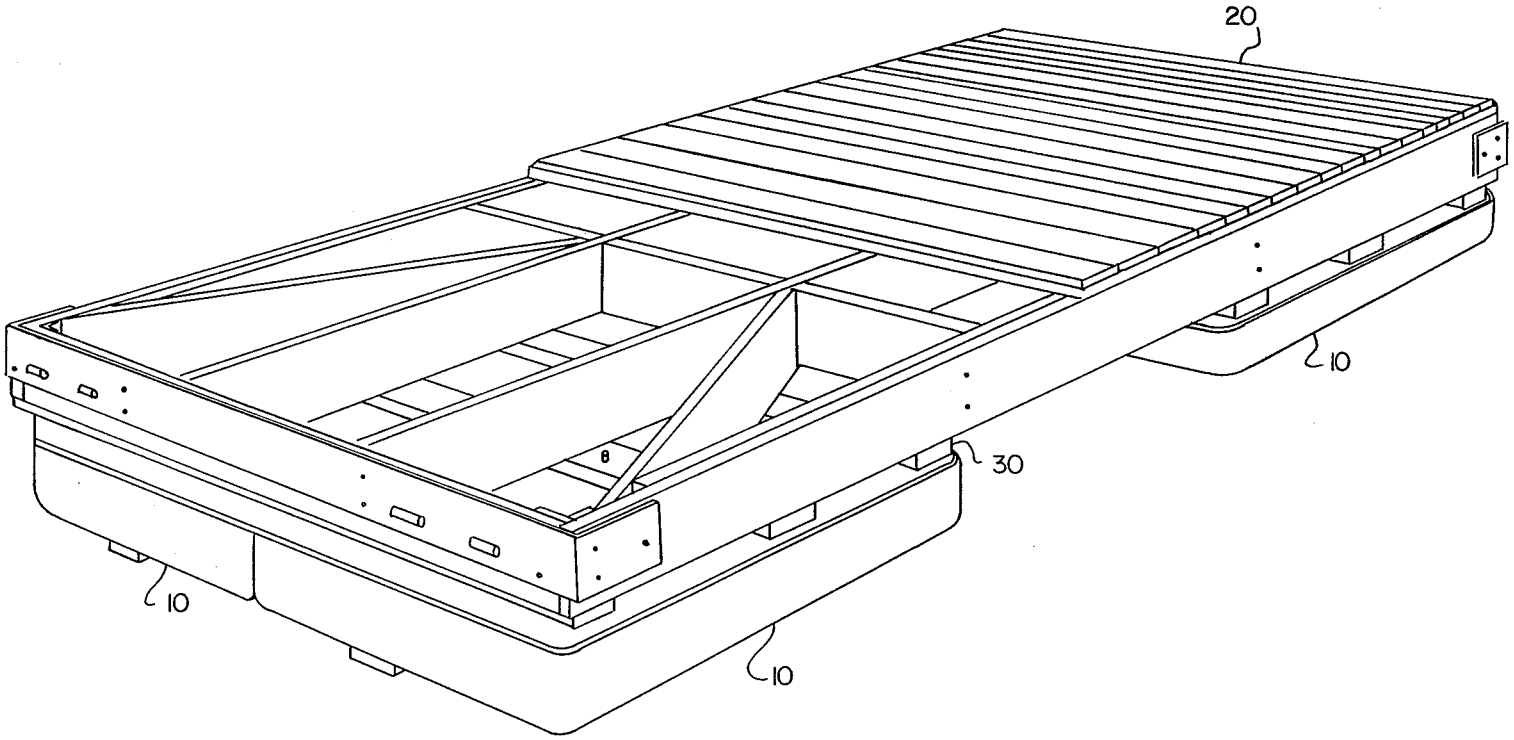
FIG. 1 is a perspective view of a segment of dock structure with pontoons according to the present invention attached thereto.
Figure 2:
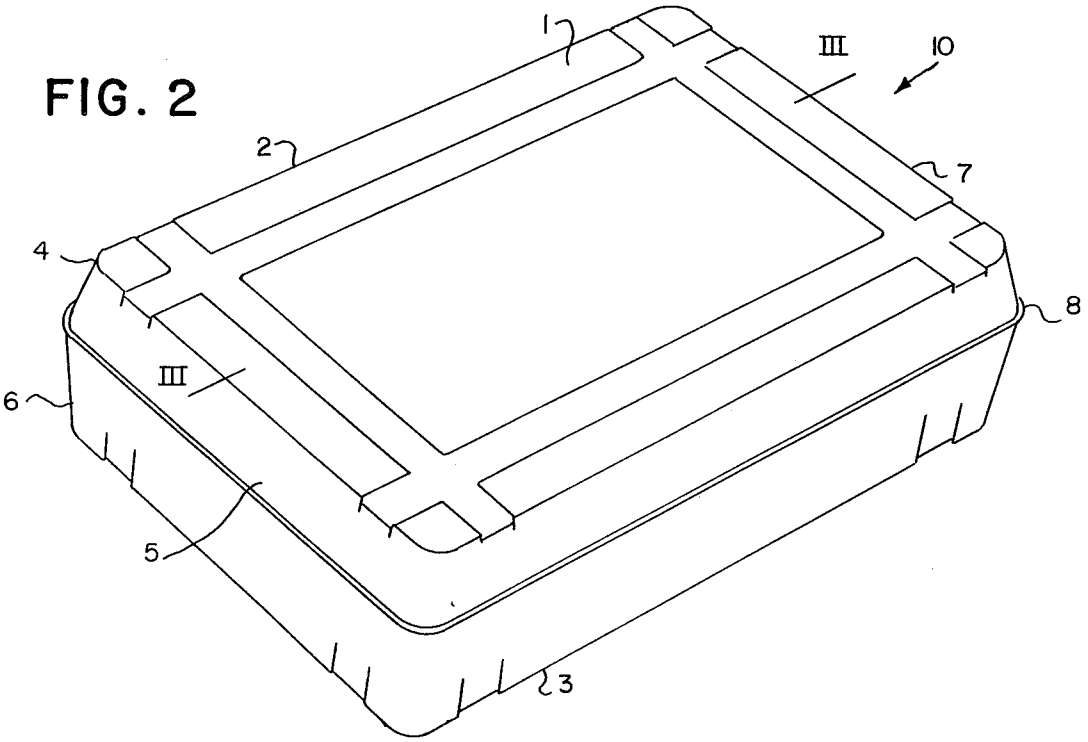
FIG. 2 is a perspective view of the present inventive pontoon.
Figure 3:
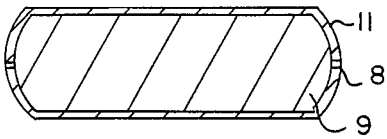
FIG. 3 shows a cross-section of the pontoon taken along line III—III of FIG. 2.

Referring first to FIG. 1, the dock structure 20 is shown with a plurality of pontoons 10 of the present invention attached to the dock bottom frame 30. As clearly shown in FIGS. 2 and 3, pontoon 10 includes a floating member 2 having a bottom 3 and a top 1 wall which have substantially the same dimensions. For example, for a bottom wall about 4' wide, the top wall is also about 4'. Bottom and top walls 1, 3 are substantially parallel with each other and are interconnected by slightly rounded sidewalls 5, 7. The thickness of floating member 2 is substantially reduced with respect to the prior art pontoons and measures about 10 inches. The prior art pontoons were either lock bolted or strapped to the dock.

Floating member 2 includes a core member 9 made of buoyant material. The core member is totally encapsulated in a plastic closure member 11. The closure member 11 includes top and bottom members 4, 6 interconnected along edges of sidewalls forming a seam 8. The closure member 11 can advantageously be made, for example, of polyethylene. Standard pontoons use different types of polyethylene. The most common is Phillips Marlex (TM), cross-linked, which has a longer life and is durable and resistant to temperature changes. The floating member 2 of the present invention utilizes as core flotation material, Dow Styrofoam R which is an extruded polystyrene foam, instead of the prior art core material of expanded polystyrene "beadboard".

The use of extruded styrofoam instead of expanded styrofoam has numerous advantages. The styrofoam is lightweight and substantially does not absorb water because of the extrusion process whereas the prior art expanded styrofoam absorbs some water between beads. The core material is much stronger and rigid, and does not easily break up on its own, whereas the beads more easily break away from each other. The density of the extruded floating material is increased to about 2 pounds per feet$^3$, whereas density of expanded polystyrene used in prior art pontoons is about 1.1 pound per foot$^3$, and no visible voids are present.

The use of the styrofoam with higher density and better mechanical strength results in a thinner floating member which generally covers more water. The lower profile and increased water coverage results in a floating dock supported by the pontoon of the present invention which is less "bouncy" and more stable than those using standard prior art pontoons.

Figure 4:
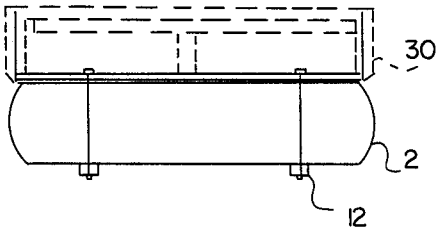
FIG. 4 shows one method of attaching the pontoon according to the present invention to dock structure.

An important feature of the present invention floating member is that it can result in a more secure attachment to the structure being supported. Due to the use of extruded foam including a multiplicity of small non-interconnecting cells, the pontoon can be pierced or dented without losing buoyancy. Therefore, through bolting can be used for securely fastening the floating member to the structure of the dock. One such method of attachment is shown in FIG. 4 where floating member 2 is connected through bolts 12 to dock structure 30.

The use of polyethylene closure 11 protects the styrofoam core 9 from disintegration in contact with gasoline, oil or salt in marina water, and also from attacks by rodents, etc. The present inventive pontoon can be manufactured as follows. The core of the styrofoam is cut to the desired shape as described above and then encased in thin sheets which form the bottom and top members 4, 6 of the polyethylene closure. This closure can be thermo-formed by molding the edges of the sidewalls of the top and bottom member together to form a seam along the joint so formed. The floating member (pontoon) has substantially equal surface width for the bottom and top members and slightly rounded sidewalls which provide only a minimum or even a non-existent taper. The thickness of the polyethylene used for the closure is typically in the range from 0.08 to about 0.25 inch.

What is claimed is:

1. A pontoon for supporting a structure in the water comprising:

a floating member including a core of buoyant material pressed between two substantially identical parts made of plastic material of higher density, said parts defining a closure member;

a first part of said two parts including a top wall and downwardly extending, outwardly rounded side walls;

a second part including a bottom wall and upwardly extending, outwardly rounded side walls, ends of said side walls of said first and second part being thermo-connected to encase said core therebetween;

wherein the thickness of said floating member is substantially smaller than its width.

2. The pontoon according to claim 1, wherein said thickness of said floating member is about 10″.

3. The pontoon according to claim 1, wherein said closure member is made of polyethylene.

4. The pontoon according to claim 1, further comprising means for fastening said floating member to said structure.

5. The pontoon according to claim 1, wherein the ratio between the thickness and the width of said floating member is about 1 to 5.

6. A pontoon for supporting a structure in the water comprising:

a floating member including a core of buoyant material pressed between two substantially identical parts made of plastic material of higher density, said parts defining a closure member;

a first part of said two parts including a top wall and downwardly extending, outwardly rounded side walls;

a second part including a bottom wall and upwardly extending, outwardly rounded side walls, ends of said side walls of said first and second part being thermo-connected to encase said core therebetween;

wherein the thickness of said floating member is substantially smaller than its width; and wherein said core is made of extruded styrofoam.

7. A pontoon for supporting a structure in the water comprising:

a floating member including a core of buoyant material pressed between two substantially identical parts made of plastic material of higher density, said parts defining a closure member;

a first part of said two parts including a top wall and downwardly extending, outwardly rounded side walls;

a second part including a bottom wall and upwardly extending, outwardly rounded side walls, ends of said side walls of said first and second part being thermo-connected to encase said core therebetween;

wherein the thickness of said floating member is substantially smaller than its width;

wherein said thickness of said floating member is about 10″; and wherein said core is made of extruded styrofoam.

8. The pontoon according to claim 7, further comprising means for fastening said floating member to said structure.

9. The pontoon according to claim 8, wherein said means for fastening includes through bolts extending through said closure and said core of said floating member.

* * * * *